US007562704B2

(12) United States Patent
Wood et al.

(10) Patent No.: US 7,562,704 B2
(45) Date of Patent: Jul. 21, 2009

(54) DELAYING SWELLING IN A DOWNHOLE PACKER ELEMENT

(75) Inventors: Edward T. Wood, Kingwood, TX (US); Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 174 days.

(21) Appl. No.: 11/487,521

(22) Filed: Jul. 14, 2006

(65) Prior Publication Data

US 2008/0011473 A1 Jan. 17, 2008

(51) Int. Cl.
*E21B 33/12* (2006.01)

(52) U.S. Cl. ..... 166/179

(58) Field of Classification Search ..... 166/179, 166/387

See application file for complete search history.

(56) References Cited

U.S. PATENT DOCUMENTS

| | | | |
|---|---|---|---|
| 2,144,026 | A | 1/1939 | Park |
| 3,918,523 | A | 11/1975 | Stuber |
| 4,137,970 | A | 2/1979 | Laflin et al. |
| 4,612,985 | A | 9/1986 | Rubbo et al. |
| 4,862,967 | A | 9/1989 | Harris |
| 4,919,989 | A | 4/1990 | Colangelo |
| 4,936,386 | A | 6/1990 | Colangelo |
| 5,048,605 | A | 9/1991 | Toon et al. |
| 5,195,583 | A | 3/1993 | Toon et al. |
| 6,073,692 | A | 6/2000 | Wood et al. |
| 6,581,682 | B1 | 6/2003 | Parent et al. |
| 6,834,725 | B2 | 12/2004 | Whanger et al. |

(Continued)

FOREIGN PATENT DOCUMENTS

| | | |
|---|---|---|
| JP | 04-363499 | 12/1992 |

(Continued)

OTHER PUBLICATIONS

Martijn Kleverlaan, et al., "Dployment Swelling Elastomer Packers in Shell E & P", SPE/IADC 92346, Feb. 2005, 1-5.

(Continued)

*Primary Examiner*—William P Neuder
(74) *Attorney, Agent, or Firm*—Steve Rosenblatt

(57) ABSTRACT

A swelling element rate regulation technique and product features an outer coating on a core of an element. The core is reactive to hydrocarbons or water depending on how it is configured. The surrounding coating is preferably formed of fine ground particles of a non-swelling polymer mixed in a solvent such as methyl-ethyl-ketone that is applied in a thin layer to the core exterior. This uncured outer layer is then contacted by a patterned surface. The patterned surface is pressed firmly against the uncured polymer/solvent mixture and transfers an inverse of the pattern to the surface of the coating. As pressure is applied, heat may also be applied to cure the coating. The resulting pattern is designed such that openings in the coating are created that regulate infiltration of water or other fluids through it and, as a result, the rate of swelling in the wellbore. Swell rate in governed in part by the ratio of the exposed area of the swelling compound to the total volume of the swelling compound. The smaller this ratio, the slower the rate of swell. The pattern created in the non-swelling layer may also provide limited mechanical restraint of the swelling element, further slowing the process.

20 Claims, 1 Drawing Sheet

U.S. PATENT DOCUMENTS

| | | | | |
|---|---|---|---|---|
| 6,848,505 | B2 | 2/2005 | Richard et al. | |
| 6,854,522 | B2 | 2/2005 | Brezinski et al. | |
| 7,143,832 | B2 | 12/2006 | Freyer | |
| 7,387,158 | B2 * | 6/2008 | Murray et al. | 166/196 |
| 2003/0037932 | A1 * | 2/2003 | Guillory et al. | 166/387 |
| 2004/0020662 | A1 | 2/2004 | Freyer | |
| 2004/0055758 | A1 | 3/2004 | Brezinski et al. | |
| 2004/0055760 | A1 | 3/2004 | Nguyen | |
| 2004/0118572 | A1 | 6/2004 | Whanger et al. | |
| 2004/0194971 | A1 * | 10/2004 | Thomson | 166/387 |
| 2004/0261990 | A1 | 12/2004 | Bosma et al. | |
| 2005/0061520 | A1 * | 3/2005 | Surjaatmadja et al. | 166/387 |
| 2005/0067170 | A1 | 3/2005 | Richard | |
| 2005/0092363 | A1 | 5/2005 | Richard et al. | |
| 2005/0110217 | A1 | 5/2005 | Wood et al. | |
| 2007/0151723 | A1 | 7/2007 | Freyer | |
| 2007/0221387 | A1 | 9/2007 | Levy | |

FOREIGN PATENT DOCUMENTS

| | | | |
|---|---|---|---|
| JP | 09-151686 | | 6/1997 |
| JP | 2000-064764 | | 2/2000 |
| WO | 02059452 | A1 | 8/2002 |
| WO | WO 2004/018836 | A1 | 3/2004 |

OTHER PUBLICATIONS

A.S. Al-Yami, et al., "Investigation of Oil Swelling Packers", SPE 113135, Jun. 2008, 1-15.

Hank Rogers, et al., "New Equipment Designs Enable Swellable Technology in Cementless Completions", IADC/SPE 112302, Mar. 2008, 1-12.

Ashraf Keshka, et al., "Practical Uses of Swellable Packer Technology to Reduce Water Cut: Case Studies from the Middle East and Other Areas", SPE 108613, Sep. 2007, 1-10.

Gary P. Hertfelder, et al., "Are Swelling-Elastomer Technology, Preperforated Liner; and Intelligent-Well Technology Suitable Alternatives to Conventional Completions Architecture?", SPE/IADC 105443, Feb. 2007. 1-13.

G. Kennedy, et al., "The Use of Swell Packers as a Replacement and Alternative to Cementing", SPE 95713, Oct. 2005, 1-4.

A.S. Al-Yami, et al., "Interactions Between Acids and Water-Swelling Elastomers", Sep. 2008, 1-30.

* cited by examiner

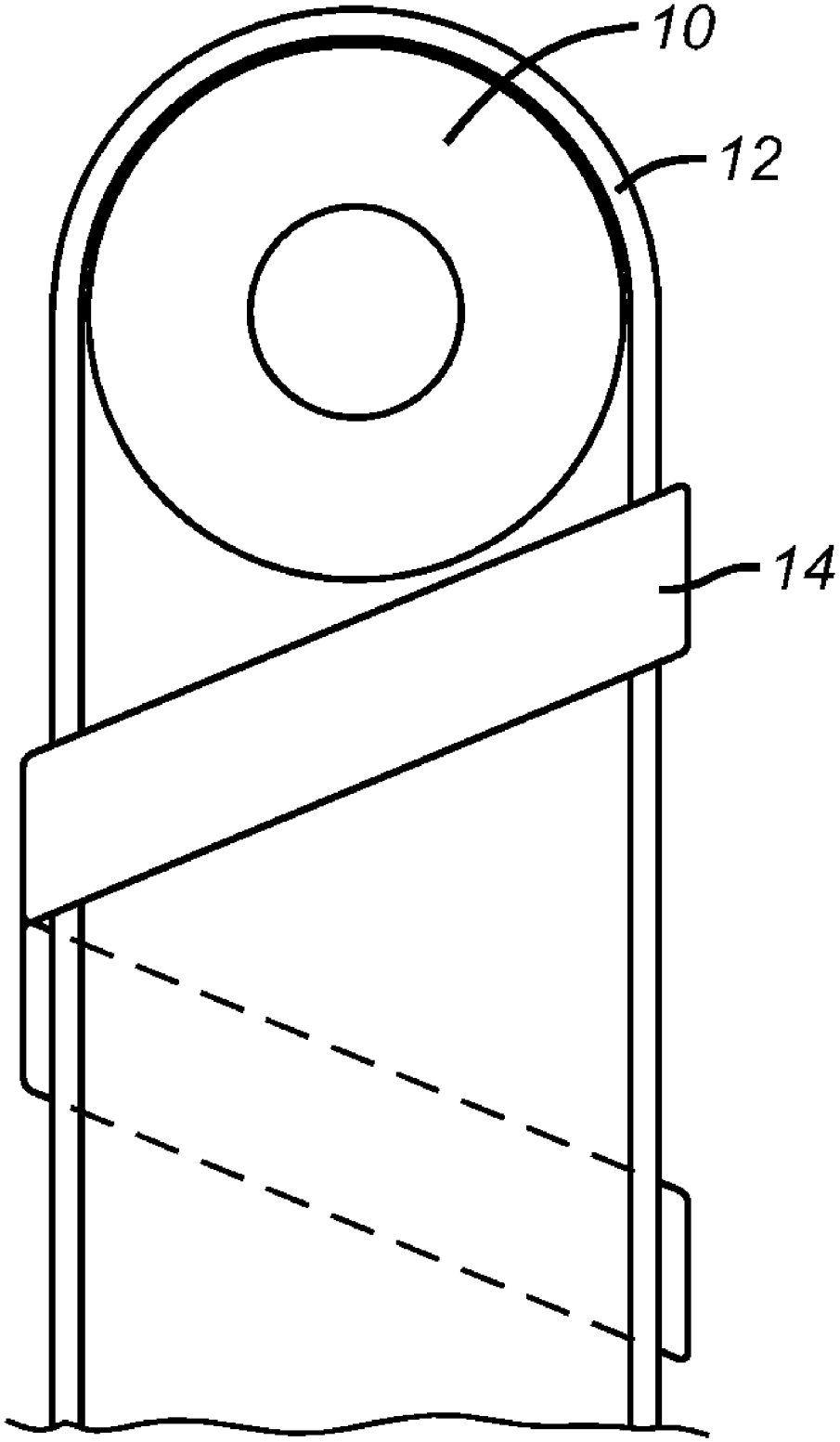
10
12
14

DELAYING SWELLING IN A DOWNHOLE PACKER ELEMENT

FIELD OF THE INVENTION

The field of this invention relates to downhole packers and plugs that use a swelling element and more particularly to design that delay the onset of swelling once the element is run downhole.

BACKGROUND OF THE INVENTION

Packers are used downhole to isolate portions of a wellbore from each other. There are many styles of packers. Some set by longitudinal compression of the sealing element by fluid pressure applied to a setting tool or by mechanical force such as from setting down weight. Other designs involve elements that are inflated. More recently, elements that swell to a sealing position on exposure to well fluids have been used. There have been many variations as outlined below.

Packers have been used that employ elements that respond to the surrounding well fluids and swell to form a seal. Many different materials have been disclosed as capable of having this feature and some designs have gone further to prevent swelling until the packer is close to the position where it will be set. These designs were still limited to the amount of swelling from the sealing element as far as the developed contact pressure against the surrounding tubular or wellbore. The amount of contact pressure is a factor in the ability to control the level of differential pressure. In some designs there were also issues of extrusion of the sealing element in a longitudinal direction as it swelled radially but no solutions were offered. A fairly comprehensive summation of the swelling packer art appears below:

I. References Showing a Removable Cover Over a Swelling Sleeve

1) Application US 2004/0055760 A1

FIG. 2a shows a wrapping 110 over a swelling material 102. Paragraph 20 reveals the material 110 can be removed mechanically by cutting or chemically by dissolving or by using heat, time or stress or other ways known in the art. Barrier 110 is described in paragraph 21 as an isolation material until activation of the underlying material is desired. Mechanical expansion of the underlying pipe is also contemplated in a variety of techniques described in paragraph 24.

2) Application US 2004/0194971 A1

This reference discusses in paragraph 49 the use of water or alkali soluble polymeric covering so that the actuating agent can contact the elastomeric material lying below for the purpose of delaying swelling. One way to accomplish the delay is to require injection into the well of the material that will remove the covering. The delay in swelling gives time to position the tubular where needed before it is expanded. Multiple bands of swelling material are illustrated with the uppermost and lowermost acting as extrusion barriers.

3) Application US 2004/0118572 A1

In paragraph 37 of this reference it states that the protective layer 145 avoids premature swelling before the downhole destination is reached. The cover does not swell substantially when contacted by the activating agent but it is strong enough to resist tears or damage on delivery to the downhole location. When the downhole location is reached, pipe expansion breaks the covering 145 to expose swelling elastomer 140 to the activating agent. The protective layer can be Mylar or plastic.

4) U.S. Pat. No. 4,862,967

Here the packing element is an elastomer that is wrapped with an imperforate cover. The coating retards swelling until the packing element is actuated at which point the cover is "disrupted" and swelling of the underlying seal can begin in earnest, as reported in Column 7.

5) U.S. Pat. No. 6,854,522

This patent has many embodiments. The one in FIG. 26 is foam that is retained for run in and when the proper depth is reached expansion of the tubular breaks the retainer 272 to allow the foam to swell to its original dimension.

6) Application US 2004/0020662 A1

A permeable outer layer 10 covers the swelling layer 12 and has a higher resistance to swelling than the core swelling layer 12. Specific material choices are given in paragraphs 17 and 19. What happens to the cover 10 during swelling is not made clear but it presumably tears and fragments of it remain in the vicinity of the-swelling seal.

7) U.S. Pat. No. 3,918,523

The swelling element is covered in treated burlap to delay swelling until the desired wellbore location is reached. The coating then dissolves of the burlap allowing fluid to go through the burlap to get to the swelling element 24 which expands and bursts the cover 20, as reported in the top of Column 8)

8) U.S. Pat. No. 4,612,985

A seal stack to be inserted in a seal bore of a downhole tool is covered by a sleeve shearably mounted to a mandrel. The sleeve is stopped ahead of the seal bore as the seal first become unconstrained just as they are advanced into the seal bore.

II. References Showing a Swelling Material Under an Impervious Sleeve

1) Application US 2005/0110217

An inflatable packer is filled with material that swells when a swelling agent is introduced to it.

2) U.S. Pat. No. 6,073,692

A packer has a fluted mandrel and is covered by a sealing element. Hardening ingredients are kept apart from each other for run in. Thereafter, the mandrel is expanded to a circular cross section and the ingredients below the outer sleeve mix and harden. Swelling does not necessarily result.

3) U.S. Pat. No. 6,834,725

FIG. 3b shows a swelling component 230 under a sealing element 220 so that upon tubular expansion with swage 175 the plugs 210 are knocked off allowing activating fluid to reach the swelling material 230 under the cover of the sealing material 220.

4) U.S. Pat. No. 5,048,605

A water expandable material is wrapped in overlapping Kevlar sheets. Expansion from below partially unravels the Kevlar until it contacts the borehole wall.

5) U.S. Pat. No. 5,195,583

Clay is covered in rubber and a passage leading from the annular space allows well fluid behind the rubber to let the clay swell under the rubber.

6) Japan Application 07-334115

Water is stored adjacent a swelling material and is allowed to intermingle with the swelling material under a sheath 16.

III. References Which Show an Exposed Sealing Element that Swells on Insertion

1) U.S. Pat. No. 6,848,505

An exposed rubber sleeve swells when introduced downhole. The tubing or casing can also be expanded with a swage.

2) PCT Application WO 2004/018836 A1

A porous sleeve over a perforated pipe swells when introduced to well fluids. The base pipe is expanded downhole.

3) U.S. Pat. No. 4,137,970

A swelling material 16 around a pipe is introduced into the wellbore and swells to seal the wellbore.

4) US Application US 2004/0261990

Alternating exposed rings that respond to water or well fluids are provided for zone isolation regardless of whether the well is on production or is producing water.

5) Japan Application 03-166,459

A sandwich of slower swelling rings surrounds a faster swelling ring. The slower swelling ring swells in hours while the surrounding faster swelling rings do so in minutes.

6) Japan Application 10-235,996

Sequential swelling from rings below to rings above trapping water in between appears to be what happens from a hard to read literal English translation from Japanese.

7) U.S. Pat. Nos. 4,919,989 and 4,936,386

Bentonite clay rings are dropped downhole and swell to seal the annular space, in these two related patents.

8) US Application US 2005/0092363 A1

Base pipe openings are plugged with a material that disintegrates under exposure to well fluids and temperatures and produces a product that removes filter cake from the screen.

9) U.S. Pat. No. 6,854,522

FIG. 10 of this patent has two materials that are allowed to mix because of tubular expansion between sealing elements that contain the combined chemicals until they set up.

10) US Application US 2005/0067170 A1

Shape memory foam is configured small for a run in dimension and then run in and allowed to assume its former shape using a temperature stimulus.

While trying to delay the progress of swelling has been tried before the problems have been in execution of a workable design. Chief among the issues affecting prior designs has been the problem of getting whatever covering was used to adhere to the underlying swelling element once introduced into the well. For example published US Application 2004/0020662 describes an embodiment having an outer nitrile layer over a nitrile element where the outer coating leaves portions of the core exposed for contact with well fluids so as to regulate the rate of swelling. What this reference does not discuss is the difficulty in getting two layers of nitrile to adhere to each other in a downhole environment. Tests with the concept disclosed in this reference have revealed that there is an adhesion problem in the interface between the layers in the downhole environment and that undermines the desired effect of regulating the rate of swelling of the underlying core of the packer element.

The present invention, applicable to element assemblies that swell in hydrocarbons or water addresses the problems of past designs by formulating a coating that will adhere and while doing so allow the migration of the fluid that triggers the swelling at the desired rate. These and other aspects of he present invention will become more apparent to those skilled in the art from a review of the description of the preferred embodiment and the associated drawing while the claims that are appended below indicate the full scope of the invention.

SUMMARY OF THE INVENTION

A swelling element rate regulation technique and product features an outer coating on a core of an element. The core is reactive to hydrocarbons or water depending on how it is configured. The surrounding coating is preferably formed of fine ground particles of a non-swelling polymer mixed in a solvent such as methyl-ethyl-ketone that is applied in a thin layer to the core exterior. This uncured outer layer is then contacted by a patterned surface. The patterned surface is pressed firmly against the uncured polymer/solvent mixture and transfers an inverse of the pattern to the surface of the coating. As pressure is applied, heat may also be applied to cure the coating. The resulting pattern is designed such that openings in the coating are created that regulate infiltration of water or other fluids through it and, as a result, the rate of swelling in the wellbore. Swell rate in governed in part by the ratio of the exposed area of the swelling compound to the total volume of the swelling compound. The smaller this ratio, the slower the rate of swell. The pattern created in the non-swelling layer may also provide limited mechanical restraint of the swelling element, further slowing the process.

DETAILED DESCRIPTION OF THE DRAWING

FIG. 1 is a perspective view showing the element with the outer coating and the surrounding weave material.

DETAILED DESCRIPTION OF THE PREFERRED EMBODIMENT

FIG. 1 shows a cylindrically shaped core 10 that can be configured to be water reactive or hydrocarbon reactive. In the preferred embodiment for a water reactive version, the bulk of the core 10 is a nitrile-based polymer with incorporated water absorbing particles. One example of such materials that absorb water is referred to as super absorbing particles or SAP. These particles absorb water and swell. The result is that the rubber swells without the water or SAP being absorbed into the rubber matrix which can adversely affect its abilities to act as a seal.

Alternatively, the core can be hydrocarbon reactive and made from an oleophillic polymer that absorbs hydrocarbons into its matrix. The swelling occurs from the absorption of the hydrocarbons which also lubricates and decreases the mechanical strength of the polymer chain as it expands. EPDM is one example of such a material.

The present inventions is an effective way to delay the swelling in either type of element by placing a coating 12 that effectively adheres to the core 10 in downhole conditions. What has been discovered actually works in this environment is taking a nitrile polymer and grinding it into a powder form with particle sizes preferable smaller than 325 mesh. The powder can be mixed with a solvent such as MEK and the mixture can be referred to as "nitrile cement." The cement coating 12 is applied in a thin layer on the outside of the element 10 and allowed to dry. After it is dry a woven material 14 is tightly wrapped over the coating 12. While FIG. 1 shows a spiral wrap other wrapping techniques can be used such as longitudinal strips or parallel circumferential wraps. The weave is preferably large rather than tight knit and the assembly is cured in an autoclave for an appropriate time. During the curing process, the coating 12 due to the superimposed weave material 14 will develop openings commensurate with the size of the weave. Alternatively, gaps in the coating 12 can develop which expose some area of the underlying core 10 while firmly adhering to the remainder of the core 10. This limited access area, whichever way it is provided, will limit the access of water or hydrocarbon or whatever the trigger material is that initiates swelling in the core 10. As the core 10 swells, it opens up the weave in material 14 to expose more core to fluid that makes it swell. Alternatively, the swelling of the core 10 opens bigger gaps between layers of weave material 10 and the swelling of the core 10 accelerates.

The above description is illustrative of the preferred embodiment and many modifications may be made by those skilled in the art without departing from the invention whose scope is to be determined from the literal and equivalent scope of the claims below.

We claim:

1. An element for a sealing device for downhole use, comprising:

a core made of a material that swells when exposed to predetermined fluids downhole and having an initial external dimension for insertion downhole;

a perforated non-swelling outer coating over said initial external dimension of said core, said perforations allow fluids to pass through and allow said core to externally swell to a larger second dimension at a predetermined initial rate that is slower than if said outer coating is not present.

2. The element of claim 1, wherein:

said perforations enlarge as said core swells.

3. The element of claim 2, wherein:

said perforations are in a grid layout.

4. The element of claim 2, wherein:

said perforations comprise a plurality of gaps in said outer coating.

5. The element of claim 1, wherein:

said coating comprises a material found in said core.

6. An element for a sealing device for downhole use, comprising:

a core made of a material that swells when exposed to predetermined fluids downhole;

an outer coating that comprises openings that allow fluids to pass through at a predetermined initial rate that is slower than if said outer coating is not present;

said coating comprises a material found in said core;

said material is in powder form and mixed with a solvent.

7. The element of claim 6, wherein:

said material comprises a nitrile.

8. The element of claim 7, wherein:

said solvent comprises methyl-ethyl-ketone.

9. The element of claim 1, wherein:

said outer coating further comprises a woven material.

10. The element of claim 9, wherein:

said perforations in said outer coating are through the weave in said material.

11. The element of claim 9, wherein:

said perforations in said outer coating are between gaps in said woven material.

12. The element of claim 9, wherein:

said perforations are created in part after application of said coating and said woven material to said core by autoclaving the assembly.

13. The element of claim 9, wherein:

said woven material comprises a nylon.

14. An element for a sealing device for downhole use, comprising:

a core made of a material that swells when exposed to predetermined fluids downhole;

an outer coating that comprises openings that allow fluids to pass through at a predetermined initial rate that is slower than if said outer coating is not present;

said coating is in powdered form and mixed with a solvent.

15. The element of claim 14, wherein:

said powder comprises a nitrile.

16. The element of claim 15, wherein:

said solvent comprises methyl-ethyl-ketone.

17. The element of claim 16, wherein:

said outer coating further comprises a woven material.

18. The element of claim 17, wherein:

said openings in said outer coating are through the weave in said material.

19. The element of claim 17, wherein:

said openings in said outer coating are between gaps in said woven material.

20. The element of claim 17, wherein:

said woven material comprises a nylon.

* * * * *